US005347202A

United States Patent [19]

Stil

[11] Patent Number: 5,347,202

[45] Date of Patent: Sep. 13, 1994

[54] DISPLAY DEVICE AND CATHODE RAY TUBE

[75] Inventor: Lambert J. Stil, Eindhoven, Netherlands

[73] Assignee: U.S. Philips Corporation, New York, N.Y.

[21] Appl. No.: 867,586

[22] Filed: Apr. 13, 1992

[30] Foreign Application Priority Data

Apr. 17, 1991 [EP] European Pat. Off. ..... 91200902.4

[51] Int. Cl.[5] ..... G09G 1/04; H01J 29/46; H01J 29/50

[52] U.S. Cl. ..... 315/382; 315/15; 313/414; 313/444

[58] Field of Search ..... 315/382, 14, 15; 313/414, 432, 437, 439, 444

[56] References Cited

U.S. PATENT DOCUMENTS 4,764,704 8/1988 New et al. ..... 313/414
4,877,998 10/1989 Maninger et al. ..... 315/15
4,935,663 6/1990 Shimona et al. ..... 313/414
5,142,190 8/1992 Koh ..... 313/414
5,162,695 11/1992 Shimona et al. ..... 313/414

FOREIGN PATENT DOCUMENTS 0234520 2/1987 European Pat. Off. .
0334197 3/1989 European Pat. Off. .
0338570 4/1989 European Pat. Off. .

*Primary Examiner*—Gregory C. Issing
*Attorney, Agent, or Firm*—Robert J. Kraus

[57] ABSTRACT

A display device comprising a deflection unit and a cathode ray tube having an in-line electron gun. The electron gun comprises a main lens portion having means to generate a main lens field and a quadrupole field. During operation, the intensity of the fields is dynamically varied. The electron gun comprises a prefocusing lens portion having means of generating a prefocusing lens field and a further quadrupole field. During operation, the intensity of said fields is controlled so that a dynamic cylindrical lens is formed in the prefocusing lens portion. By virtue thereof, an improved picture reproduction can be obtained.

10 Claims, 2 Drawing Sheets

DISPLAY DEVICE AND CATHODE RAY TUBE

BACKGROUND OF THE INVENTION

The invention relates to a display device comprising a cathode ray tube and a deflection unit, the cathode ray tube including an in-line electron gun having a main lens portion with means to generate a main lens field and a quadrupole field, and the display device comprising means to vary dynamically the strength of the main lens field and of the quadrupole field.

The invention also relates to a cathode ray tube which is suitable for use in a display device.

Display devices are used in, inter alia, television receivers and colour monitors.

In operation, the deflection unit generates an electromagnetic field for deflecting electron beams generated by the in-line electron gun across the display screen. The deflection field has a defocusing effect on the electron beams and causes astigmatism. Said effects vary with the degree of deflection. The electron gun comprises means to generate a main lens field and a quadrupole field and the display device comprises means to vary dynamically the strength of the main lens field and of the quadrupole field. This enables astigmatism and focusing of the electron beams as a function of deflection to be controlled so that astigmatism caused by the deflection field is at least partly compensated and that the electron beams are substantially in focus everywhere on the display screen. This improves the reproduction of the picture. Such electron guns are sometimes referred to in literature as DAF-guns (Dynamic-Astigmatism and Focusing).

SUMMARY OF THE INVENTION

It is an object of the invention to provide a cathode ray tube of the type described in the opening paragraph, having an improved picture reproduction.

In the display devices according to the state of the art, disturbing picture errors may occur in particular at the edges of the display screen and in colour display tubes having a deflection angle of 110°. For example Moiré effects may occur and/or characters become less distinct as they are reproduced closer to the edge of the display screen. It is an object of the invention to provide a display device in which said disturbing effects which adversely affect picture reproduction are reduced.

To this end, a display device according to the invention is characterized in that it comprises means to generate a dynamic cylindrical lens in a position in front of the main lens portion, which cylindrical lens has substantially no lens action in a direction parallel to the in-line plane.

The invention is, inter alia, based on the insight that in a display device of the type mentioned in the opening paragraph very small vertical spots may occur at the edges of the screen causing the above-mentioned effects. Vertical is to be understood to mean herein a direction transversely to the in-line plane and horizontal is to be understood to mean herein a direction parallel to the in-line plane. By virtue of the invention, the vertical spot sizes can be influenced and hence said negative effects can be reduced without adversely affecting the beam section in the horizontal direction. A change of the beam section in the horizontal direction has negative effects.

An embodiment of the invention is characterized in that the electron gun comprises a prefocusing lens portion having means to generate a prefocusing lens field and a further quadrupole field, and in that the display device comprises means to dynamically vary the strength of the prefocusing lens field and the further quadrupole field, a dynamic cylindrical lens having substantially no lens action in a direction parallel to the in-line plane being formed in the prefocusing lens portion during operation.

A quadrupole field modulates the shape of an electron beam. It reduces the size of the electron beam in one direction and it increases the size of an electron beam in a direction perpendicularly to said direction. A prefocusing field influences, that is increases or reduces, the size of an electron beam in all directions to an approximately equal degree.

When a display device according to the invention is in operation, the quadrupole field in the prefocusing lens portion dynamically modulates the spot size both in the vertical and the horizontal direction. By carrying out the dynamic modulation of the vertical spot size as a function of the deflection it can be precluded that the vertical spot size at the edges of the screen becomes too small. Simultaneously, however, the horizontal spot size is modulated, which is mostly undesirable because the horizontal spot size is optimal for the main lens in a first-order approximation. In a display device according to the invention, the prefocusing lens field can also be dynamically controlled and it modulates the spot size both in the horizontal and the vertical direction, the dynamic effects of the prefocusing lens field and of the quadrupole field in the prefocusing portion on the horizontal beam width being of substantially the same order of magnitude but of opposite sign. If, for example, the further quadrupole field reduces the horizontal dimension of an electron beam as said beam gets closer to the edge of the display screen, the prefocusing lens field increases the horizontal dimension such that the sum of the effects of the further quadrupole lens and the prefocusing field is negligibly small, so that the dynamic lens formed in the prefocusing portion has substantially no horizontal component. The effects of the quadrupole field and prefocusing field on the beam section in the vertical direction, i.e. the vertical dimension of an electron beam, intensify each other, resulting in a large dynamic range, i.e. the relative change of the beam section in the vertical direction per volt is substantial. Effects at the edges are relatively small.

Preferably, the means of generating the prefocusing field and the further quadrupole field are constructed so that, in operation, only one prefocusing lens field and only one quadrupole field are generated in the prefocusing portion. It was found that a dynamic cylindrical lens can be manufactured in this simple manner.

A preferred embodiment is characterized in that the means of generating the prefocusing field and the further quadrupole field are electrodes which are constructed so that the dynamic cylindrical lens can be excited with only one dynamic voltage. Thus, the dynamic cylindrical lens can be excited in a simple manner.

In an embodiment, the in-line electron gun comprises, viewed in the direction of travel of the electron beams, a first common electrode, a second common electrode, a third common electrode and a further electrode, which electrodes have apertures for transmitting the electron beams, and the display device comprises means of applying the dynamic voltage to the third common electrode.

BRIEF DESCRIPTION OF THE DRAWING

A few exemplary embodiments of the display device according to the invention will be described with reference to the accompanying drawing, in which.

The Figures are not drawn to scale. In each of the Figures, corresponding parts generally bear the same reference numerals.

DESCRIPTION OF THE PREFERRED EMBODIMENT

Figure 1:
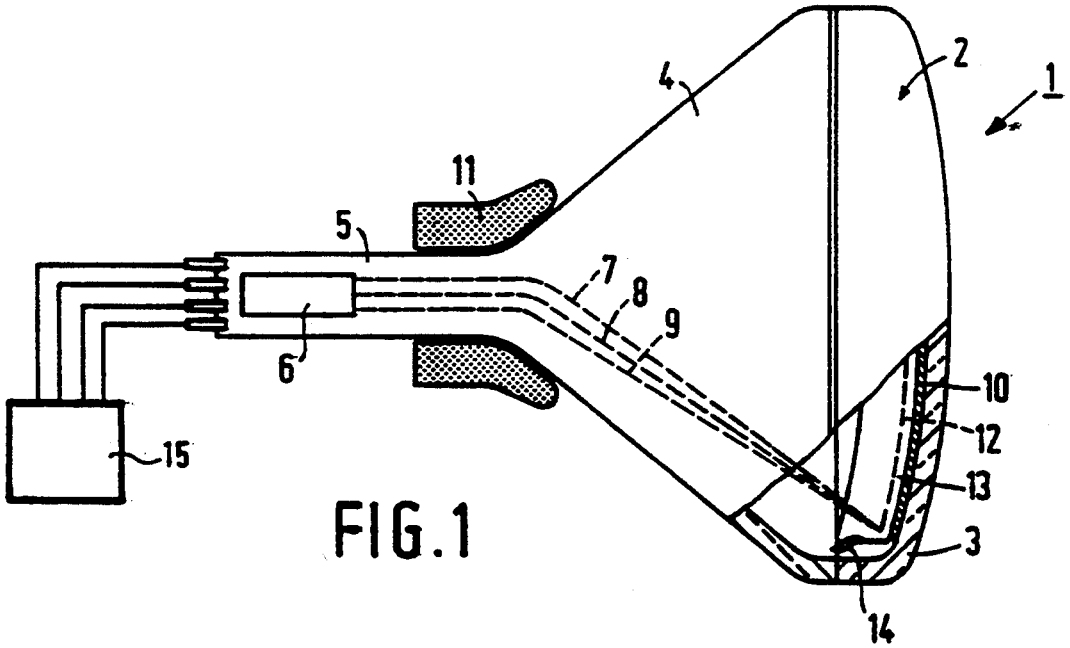
FIG. 1 is a sectional view of a display device according to the invention.

The display device comprises a cathode ray tube, in this example colour display tube 1, having an evacuated envelope 2 which consists of a display window 3, a cone portion 4 and a neck 5. In the neck 5 there is provided an electron gun 6 for generating three electron beams 7, 8 and 9 which extend in one plane, the in-line plane which in this case is the plane of the drawing. A display screen 10 is provided on the inside of the display window. Said display screen 10 comprises a large number of phosphor elements luminescing in red, green and blue. On their way to the display screen 10, the electron beams 7, 8 and 9 are deflected across the display screen 10 by means of deflection unit 11 and pass through a colour selection electrode 12 which is arranged in front of the display window 3 and which comprises a thin plate with apertures 13. The colour selection electrode is suspended in the display window by means of suspension means 14. The three electron beams 7, 8 and 9 pass through the apertures 13 of the colour selection electrode at a small angle with each other. Consequently, each electron beam impinges on phosphor elements of only one colour. The display device further comprises means 15 for generating voltages which, in operation, are applied to components of the electron gun.

Figure 2:
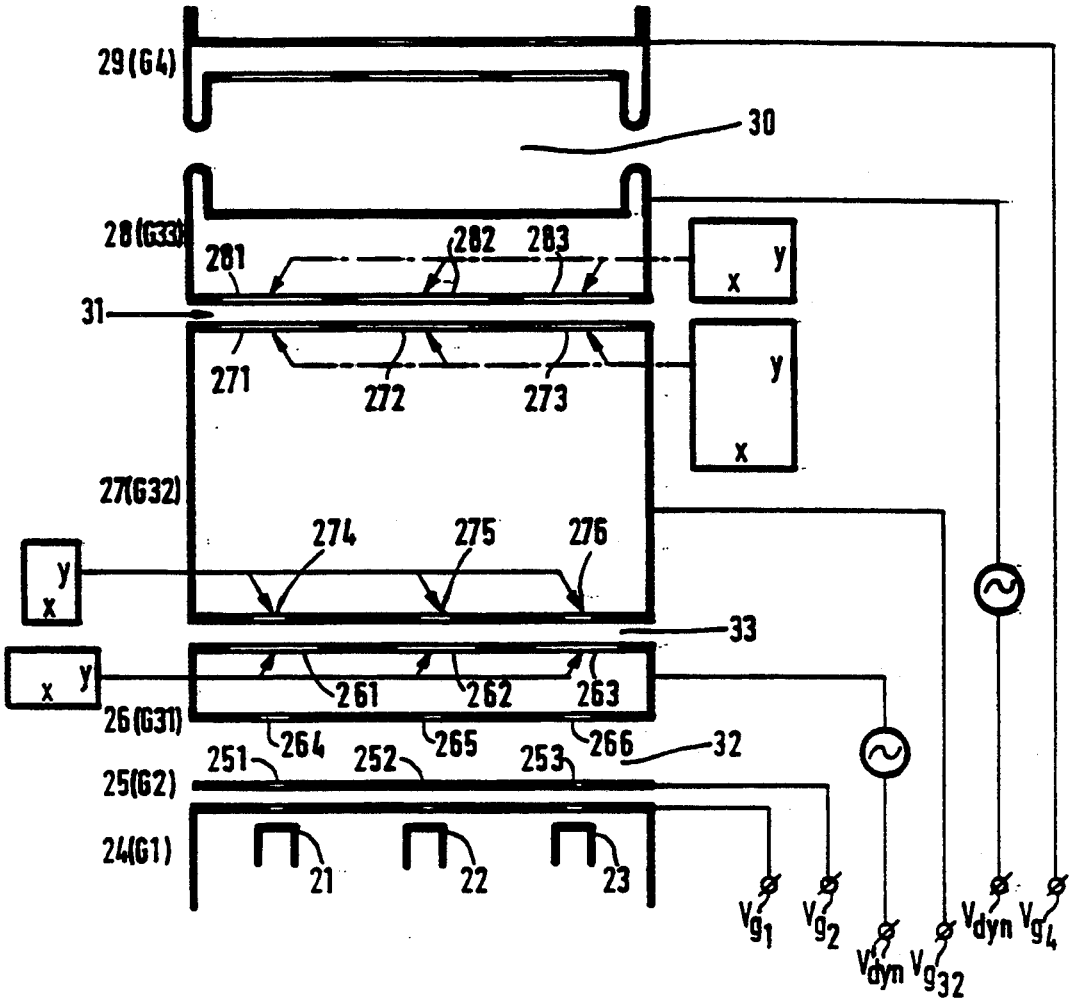
FIG. 2 is a sectional view of an electron gun which can suitably be used in a cathode ray tube for a display device according to the invention.

FIG. 2 is a sectional view of an electron gun which is suitable for use in a cathode ray tube according to the invention. The electron gun 6 comprises three cathodes 21, 22 and 23. It further comprises a first common electrode 24 ($G_1$), a second common electrode 25 ($G_2$), a third common electrode 26 ($G_{31}$), a fourth common electrode 27 ($G_{32}$), a fifth common electrode 28 ($G_{33}$) and a sixth common electrode 29 ($G_4$). Electrodes 29 ($G_4$) and 28 ($G_{33}$) form an electron-optical element in the main lens portion of the electron gun for generating a main lens field which is formed, in operation, between said electrodes 28 and 29 in space 30. Electrodes 28 ($G_{33}$) and 27 ($G_{32}$) form an electron-optical element in the main lens portion of the electron gun for generating a quadrupole field which, in operation, is generated between the electrodes 28 and 27 in space 31. The electrodes have connections for applying electric voltages. The display device comprises leads, not shown, for applying electric voltages which are generated in the means 15. The cathodes and the electrodes 24 and 25 form the so called triode portion of the electron gun. Electrodes 25 ($G_2$) and 26 ($G_{31}$) form an electron-optical element in the prefocusing portion of the electron gun for generating a prefocusing field approximately in space 32. Electrodes 27 ($G_{32}$) and 26 ($G_{31}$) form an electron-optical element in the prefocusing portion of the electron gun for generating a quadrupole field in space 33 between the electrodes 26 and 27. All electrodes have apertures for transmitting the electron beams. In this example, apertures 281,282 and 283 are rectangular as are apertures 271,272 and 273. This is diagrammatically shown by means of rectangles beside the apertures. Apertures 274, 275 and 276, and apertures 261,262 and 263 are also rectangularly shaped as is diagrammatically shown beside said apertures. In operation, a dynamic potential $V_{dyn}$ is applied to electrode 28 ($G_{33}$). Said potential $V_{dyn}$ typically exhibits a dynamic variation of the order of magnitude of several hundred volts to several kV above or below a value of approximately 8 kV. In operation, a potential $V_{G4}$ of approximately 25 kV to 30 kV is applied to electrode 29 ($G_4$), also termed anode. The electron beams are deflected across the display screen by deflection unit 11. The electromagnetic deflection field also has a focusing effect and causes astigmatism. Said effects are governed by the deflection angle of the electrons. The dynamic voltage $V_{dyn}$ varies as a function of the deflection angle of the electron beams. This enables astigmatism caused by the electromagnetic deflection field to be at least substantially compensated and to keep the focusing at least substantially constant. Electron guns comprising such a main lens portion are sometimes referred to in literature as DAF guns Dynamic Astigmatism and Focusing).

Particularly in the case of colour display tubes having a substantial (for example 110° or more) angle of deflection, disturbing effects may occur at the edges of the display screen. So-called Moire effects may occur, and the readability of characters may be reduced. The electron gun according to the invention comprises a prefocusing portion having a dynamic cylindrical lens. In this example, the apertures 25 1,252 and 253 in electrode 25 ($G_2$) are round, as are the apertures 264, 265 and 266 in electrode 26 ($G_{31}$). In operation, a rotationally symmetrical prefocusing lens is formed between the electrodes 25 and 26, which lens varies just as much in the horizontal (x) direction as in the vertical (y) direction as a function of a dynamic potential $V'_{dyn}$ applied to electrode 26 ($G_{31}$). In operation, an approximately quadrupole field is generated between the electrodes 26 ($G_{31}$) and 27 ($G_{32}$). The apertures are selected so that the effect of a dynamic variation of the potential applied to electrode 26 ($G_{31}$) on the beam size in the horizontal direction and brought about in the prefocusing lens is at least substantially of the same magnitude, but of opposite sign, as the effect on the beam size in the horizontal direction brought about in the quadrupole field. In this case, there is no dynamic lens action in the horizontal direction. In the vertical direction the lens actions of the prefocusing lens and the quadrupole field intensify each other. This results in the formation of a dynamic cylindrical lens. The beam size in the horizontal direction is at least substantially independent of the dynamic voltage $V'_{dyn}$. Table 1 shows half the beam angle in the x-direction (x) and in the y-direction (y) of the electron beams on the display green, as a function of the potential $V'_{dyn}$ applied to electrode 26 ($G_{31}$). In this example, it holds that:

diameter of apertures in electrode 26 ($G_2$): 1.2 mm
diameter of apertures 264, 265 and 266: 1.2 mm
apertures 261,262 and 263: 2.4(x)×3.0(y)mm
apertures 274, 275 and 276: 3.0(x)×2.4(y)mm where the potential $V_{G2}$ applied to electrode 25 ($G_2$) is approximately 700 Volts and the potential $V_{32}$ applied to electrode 27 ($G_{32}$) is approximately 8400 Volts.

TABLE 1 half the beam angle in the x- and y-directions as a function of the dynamic potential $V'_{dyn}$.

| $V'_{dyn}$ (Volt) | half the beam angle (mrad) x | y |
|---|---|---|
| 7400 | 43.08 | 53.71 |
| 8400 | 43.49 | 43.48 |
| 9400 | 43.39 | 35.69 |

Figure 3A:
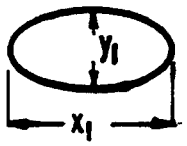
FIGS. 3*a* and 3*b*, 4*a* and 4*b* illustrate the effect of the invention on the beam section.
Figure 3B:
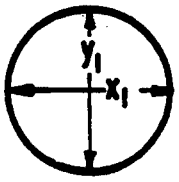
Figure 4A:
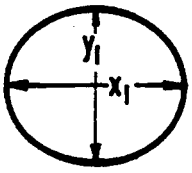
Figure 4B:
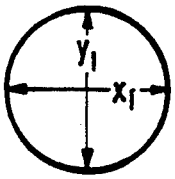

The beam section in a direction (in this example the x or y-direction) on the display screen is governed by the beam angle in said direction, in the following manner: the beam angle is the angle ($\alpha$) at which the electron beam enters the main lens. For a main $$HL = \frac{\alpha}{2} * B * \sqrt{V}$$

lens it holds that the Helmholtz-Lagrange product (HL) is constant in a first-order approximation, which product complies with the equation where B is the beam section in the direction in question and V is the voltage applied to the anode. The beam section increases as the beam angle decreases. The beam angle and, hence, the beam section in the vertical (y)-direction can be varied substantially (with a factor of 1.5), as shown in Table 1, by varying the dynamic potential $V'_{dyn}$ applied to electrode 26 ($G_{31}$) while, simultaneously, the beam angle and thus the beam section in the x-direction remains substantially constant (in this example the beam section in the x-direction changes less than 1%, in general, a beam section is regarded as substantially constant in the x-direction if the change of the beam section in the x-direction is less than approximately 10% of the change in the y-direction). FIGS. 3*a* and 3*b* show the beam shape at the end of the long axis (A) and in the centre of the screen (B), respectively, in known tubes comprising a DAF-gun. The beam section in the x-direction $x_1$ increases slightly towards the edge of the screen, in the y-direction the beam section $y_1$ decreases substantially. Said decrease of the beam section may have the above-mentioned adverse effects on picture quality (inter alia Moiré effects). FIGS. 4*a* and 4*b* show the effect of the invention. The beam section $x_1$ in the x-direction remains substantially unchanged relative to the beam section $x_1$ shown in FIGS. 3*a* and 3*b*, the beam section $y_1$ in the y-direction is increased towards the end of the long axis as a result of a change of the potential $V'_{dyn}$. By virtue thereof, Moiré effects and other disturbing effects can be precluded without there being a change of the beam section in the x-direction.

Within the scope of the invention many variations are possible to those skilled in the art. A few variations are, for example,:

In the example shown, a dynamic cylindrical lens is formed by a combination of a dynamic quadrupole lens and a dynamic approximately rotationally symmetrical lens. A single dynamic cylindrical lens can be formed, for example, by two oppositely arranged electrodes having elongated slits. Embodiments in which the dynamic cylindrical lens is formed by a combination of one or more dynamic rotationally symmetrical lenses and one or more quadrupole lenses have the advantage of a greater dynamic range of the cylindrical lens and fewer disturbing effects at the edges.

The means used to generate a quadrupole field or a further quadrupole field can also be used to generate higher multipole fields such as, for example, hexapole and octapole fields;

The intensities of the quadrupoles and higher multipoles need not be the same for the three electron beams. This enables a possible difference in higher order effects between the outside beams and the central beam to be compensated;

In the example, the quadrupole fields are generated between two electrodes having quadrangular apertures. The apertures may alternatively be oval, elongated or polygonal;

A quadrupole field may be generated in a different manner, for example, by raised, oppositely located edges at apertures for transmitting electron beams;

In operation, the quadrupole field may be located, viewed in the direction of travel of the electron beams, in front of or behind the main lens field or be integrated therein. The further quadrupole field may be located in front of or behind the prefocu sing lens field or be integrated therein.

Both in the main lens portion and in the prefocusing lens portion more than one quadrupole field can be generated.

The embodiment shown in which the means of generating the prefocusing field and the further quadrupole field are constructed so that in the prefocusing portion only one prefocusing lens field and only one quadrupole field are generated is a preferred, simple embodiment. If more than one quadrupole field is generated, a greater dynamic range may be obtained, which is favourable, but positioning errors of the quadrupole fields relative to each other may lead to picture errors, which is unfavourable, and possibly more than one dynamic voltage is required which complicates the excitation.

The dynamic excitation of the prefocusing field and the quadrupole field can take place separately. For example, electrode 26 in FIG. 2 can be divided in two portions, one portion comprising the apertures 261,262 and 263 and the other portion comprising the apertures 264, 265 and 266, both portions being excited by a dynamic voltage. It is advantageous when the means of generating the prefocusing field and the quadrupole field are constructed so that the dynamic cylindrical lens can be excited with only one dynamic voltage, as is the case in the example stated above. In this example the dynamic voltage is applied to the common electrode $G_{31}$. The apertures in said electrode are constructed so that the dynamic effects of the prefocusing lens and the quadrupole lens parallel to the in-line plane substantially compensate each other.

I claim

1. A display device comprising a cathode ray tubed and a deflection unit, said cathode ray tube including an electron gun for producing a plurality of coplanar electron beams, said electron gun having a main lens portion, through which said beams pass, said display device including means for producing in said main lens portion a main lens field and a quadrupole lens field having dynamically varying strengths, characterized in that the display device further includes means for producing a cylindrical lens field having a dynamically varying strength through which said beams pass before entering the main lens portion, said cylindrical lens field effecting substantially no variation of the beam cross-sectional sizes in a first direction parallel to the plane of the beams while effecting a substantial variation of the beam cross-sectional sizes in a second direction transverse to said plane.

2. A display device as in claim 1, characterized in that the electron gun comprises a prefocusing lens portion having means to generate a prefocusing lens field and a further quadrupole field, and in that the display device comprises means to dynamically vary the strength of the prefocusing lens field and the further quadrupole field, a dynamic cylindrical lens having substantially no lens action in a direction parallel to the in-line plane being formed in the prefocusing lens portion during operation.

3. A display device as in claim 2, characterized in that the means to generate the prefocusing field and the further quadrupole field are constructed so that, in operation, only one prefocusing lens field and only one quadrupole field are generated in the prefocusing portion.

4. A display device as in claim 2 or 3, characterized in that the means to generate the prefocusing field and the further quadrupole field are constructed so that the dynamic cylindrical lens can be excited with only one dynamic voltage.

5. A display device as in claim 4, characterized in that the in-line electron gun, viewed in the direction of travel of the electron beams, comprises a first common electrode, a second common electrode, a third common electrode and a further electrode, which electrodes have apertures for transmitting electron beams, and in that the display device comprises means to apply the dynamic voltage to the third common electrode.

6. A display device as in claim 1 where the means for producing the cylindrical lens field comprises means for producing, in succession along the direction of travel of the beams, a rotationally symmetrical prefocusing lens field and a quadrupole lens field.

7. A display device as in claim 6 where, in the cylindrical lens field, each of the rotationally symmetrical prefocusing lens field and the quadrupole lens field effect variation of the beam cross-sectional sizes in both the first and second directions, said variations in the first direction being of substantially equal magnitude but of opposite sign.

8. A cathode ray tube comprising an envelope supporting a luminescent screen and containing an electron gun for producing a plurality of coplanar electron beams for impinging on said screen, said electron gun having a main lens portion, through which said beams pass, and including means for producing in said main lens portion a main lens field and a quadrupole lens field having dynamically varying strengths, characterized in that the electron gun further includes means for producing a cylindrical lens field having a dynamically varying strength through which said beams pass before entering the main lens portion, said cylindrical lens field effecting substantially no variation of the beam cross-sectional sizes in a first direction parallel to the plane of the beams while effecting a substantial variation of the beam cross-sectional sizes in a second direction transverse to said plane.

9. A cathode ray tube as in claim 8 where the means for producing the cylindrical lens field comprises means for producing, in succession along the direction of travel of the beams, a rotationally symmetrical prefocusing lens field and a quadrupole lens field.

10. A cathode ray tube as in claim 9 where, in the cylindrical lens field, each of the rotationally symmetrical prefocusing lens field and the quadrupole lens field effect variation of the beam cross-sectional sizes in both the first and second directions, said variations in the first direction being of substantially equal magnitude but of opposite sign.

* * * * *